US005355976A

United States Patent [19]

Goto et al.

[11] Patent Number: 5,355,976

[45] Date of Patent: Oct. 18, 1994

[54] HANDLING APPARATUS FOR AUTOMATIC WAREHOUSING ARRANGEMENT

[75] Inventors: Yukihiro Goto; Yoshihiko Yamada, both of Komaki, Japan

[73] Assignee: Daifuku Co., Ltd., Osaka, Japan

[21] Appl. No.: 95,666

[22] Filed: Jul. 21, 1993

[30] Foreign Application Priority Data

Jul. 31, 1992 [JP] Japan ..... 4-204154
Jul. 31, 1992 [JP] Japan ..... 4-204156

[51] Int. Cl.[5] ..... B66B 7/02

[52] U.S. Cl. ..... 187/406; 414/277; 52/745.17; 187/410

[58] Field of Search ..... 187/95, 9 R, 9 E, 1 R; 414/277-283; 52/745.2, 745.17, 745.18, 745.03, 745.1, 745.04, 123.1; 104/119, 118, 245, 247

[56] References Cited

U.S. PATENT DOCUMENTS 2,100,169 11/1937 Norton ..... 187/95
3,881,424 5/1975 Thompson ..... 414/277
4,572,719 2/1986 Theobald ..... 414/277
4,823,704 4/1989 Fujita et al. ..... 104/247

FOREIGN PATENT DOCUMENTS 218407 9/1988 Japan .
63-218407 9/1988 Japan .

*Primary Examiner*—Kenneth W. Noland
*Attorney, Agent, or Firm*—Barnes, Kisselle, Raisch, Choate, Whittemore & Hulbert

[57] ABSTRACT

A handling apparatus for warehousing arrangement which is supported on and guided by a floor rail installed in, for example, a factory for movement along a predetermined track provided in front of load-in/load-out sections of a rack. A pair of front and rear posts upstanding from a travel carriage of the handling apparatus and spaced from each other in the dirction of horizontal movement of the carriage have opposed surfaces on which are formed front and rear guide faces. The elevator is guided at one and the other ends thereof by and along the front and rear guide faces so that the elevator is vertically movable along the guide faces. Cord members for vertical drive are arranged along the opposed surfaces of the pair of posts and are connected to the elevator. On the opposed surfaces of the posts at positions opposite to the cord members is defined a relief spacing between each cord member and each respective post.

4 Claims, 5 Drawing Sheets

HANDLING APPARATUS FOR AUTOMATIC WAREHOUSING ARRANGEMENT

FIELD OF THE INVENTION

The present invention relates to a handling apparatus for warehousing arrangement which is supported on and guided by a floor rail installed in, for example, a factory for movement along a predetermined track provided in front of load-in/load-out sections of a rack.

BACKGROUND OF THE INVENTION

An automatic warehousing arrangement including racks and a handling apparatus has been known, as described in, for example, Japanese Patent Application Laid-Open No. 63-218407. In this known arrangement, the handling apparatus or a crane comprises a lower frame, a pair of guide posts, front and rear, upstanding from the lower frame and spaced in the direction of back and forth movement of the crane, an upper frame interconnecting the top ends of the guide posts, and a vertically movable carriage guided along the guide posts. The vertically movable carriage carries a transfer device, such as a fork.

The posts have guide rail portions of an open groove shape formed on inwardly opposed surfaces thereof. The vertically movable carriage is provided at its front and rear ends each with a movable shaft urged by a spring for projection outward. Mounted to each movable shaft are a first guide roller for inhibiting longitudinal oscillations which contacts the bottom of the corresponding guide rail portion, and a second guide roller for inhibiting lateral oscillaions which is opposed to sides of the guide rail portion. Each post is hollow in its interior, the hollow interior being utilized for arrangement of a vertical drive chain which extends vertically in and outside the post. The vertical drive chain is connected to the vertically movable carriage.

According to this known arrangement, load transfer between the rack and the crane is carried out by a combination of horizontal movement of the crane on a predetermined track extending along the front of load-in/load-out sections of the rack, vertical movement of the carriage, and lateral stretch and retraction of a load transfer device. For this purpose, upward and downward movement of the vertically movable carriage is performed by the vertical drive chain being driven to run. The first guide rollers for inhibiting longitudinal oscillations and second guide rollers for inhibiting lateral oscillations are guided along the guide rail portions, whereby the vertically movable carriage can be moved upward and downward while being prevented from longitudinal and lateral oscillations.

According to such known arrangement, the vertical drive chains, positioned outside the posts and connected to the ends of the vertically movable carriage, are positioned close to the outer sides of the respective posts. Therefore, the vertical drive chains tend to sway back and forth during their run and may impinge upon outer surfaces of the posts. To avoid such an occurrence, the pair of posts may be sufficiently spaced from each other so as to allow the vertical drive chains to be positioned away from the outer surfaces of the respective posts, whereby the chains can be prevented from colliding with the outer surfaces of the posts. In this case, however, some adverse effect may be caused to the structural aspect of various parts of the crane.

In place of the vertical drive chain, other kind of cord element, such as wire rope, may be used to drive the vertically movable carriage for upward and downward movement. However, in that case, too, a similar problem is likely to occur.

According to the above described prior-art arrangement, the second guide rollers for inhibiting lateral oscillations are dimensionally so designed as to produce a clearance in relation to at least one side of the open-groove shaped guide rail portion, since smooth guidance through free rotation of the rollers cannot be effected if the rollers simultaneously come in contact with both sides of the guide rail portion. The presence of this clearance is a cause of jolting during a load transfer, in particular, in which the fork of the load transfer device is stretched and retracted. This does not permit any smooth and accurate load transfer, and may even result in generation of large noise when operation is carried out at high speed. Such jolting will also occur during upward and downward movement of the vertically movable carriage.

The first guide rollers for inhibiting longitudinal oscillations are each held in contact with the bottom of the corresponding guide rail portion by the resilient force of the spring and, therefore, they can absorb any surface irregularity of the guide rail portion to maintain the carriage constantly in a jolting-free condition. In this case, however, the second guide rollers for inhibiting lateral oscillations as mounted to each movable shaft are caused to shift in unison with the first guide rollers in the direction in which the first guide rollers are biased for surface contact, and this results in a lateral pressure being exerted on the second guide rollers. As a consequence, the second guide rollers are liable to some frictional wear which will in turn unfavorably affect the environment due to dust generation and will further enlarge the above mentioned clearance.

DISCLOSURE OF THE INVENTION

It is an object of the invention to provide an arrangement for preventing cord elements, such as chains, from colliding with posts without requiring the posts to be spaced wider from each other and to enable the arrangement to be utilized in guiding an elevator for upward and downward movement thereof.

It is another object of the invention to enable the elevator to be constantly smoothly guided jolting-free by guide posts in the direction of back and forth movement of the elevator and also in the direction of its lateral movement, and thereby to minimize possible frictional wear of the rollers.

In order to accomplish these objects, the handling apparatus for automatic warehousing arrangement in accordance with the invention comprises:

a travelling carriage body, a pair of front and rear posts vertically extending from the travelling carriage body and spaced from each other in the direction of movement of the carriage body, front and rear guide faces formed on the opposed surfaces of the posts, an elevator guided at one and the other ends thereof by the front and rear guide faces for upward and downward movement along the guide faces, cord means for vertically driving the elevator arranged along at least one of the opposed surfaces of the pair of posts and connected to the elevator, and relief spaces defined on the opposed surfaces of the posts at a position opposite to the cord means so as to provide a spacing between the cord means and the respective posts.

According to such arrangement, upward and downward movement of the elevator can be performed by moving the cord means for vertical drive in the forward and reverse directions. The cord means, while in their travel, may joggle in the direction of back and forth movement, but by virtue of the relief space provided in the direction of such joggling, it is possible to avoid the occurrence of such an interference as collision of the cord means with the posts, without requiring the posts to be spaced more than reasonably necessary even if the joggling is of a relatively large amplitude. Therefore, smooth vertical movement of the elevator can always be reasonably expected.

In another embodiment of the invention, the handling apparatus for automatic warehousing arrangement comprises rollers for inhibiting back and forth oscillations which are disposed on the elevator and respectively guided by and along the front and rear guide faces of the posts, and rollers formed from an elastic resin material for inhibiting lateral oscillations which are disposed on the elevator and respectively guided by and along side guide faces of the posts.

According to such arrangement, the rollers on the elevator for inhibiting lateral oscillations operate to positively hold the side guide faces therebetween, so that load transfer can be smoothly performed with no joggling. Upward and downward movement of the elevator can be smoothly performed jolting-free and, by virtue of the elastic properties of the rollers for inhibiting lateral oscillations, any surface irregularity present on the side guide faces of the posts is conveniently absorbed so that operation of the apparatus can be constantly kept in a joggling-free condition. Thus, it is possible to achieve high-speed operations without involving large noise occurrences.

In a further embodiment of the invention, the handling apparatus for automatic warehousing arrangement comprises means for resiliently urging the rollers for inhibiting back and forth oscillations to go into contact with the front and rear guide faces of the posts.

According to this arrangement, only the rollers for inhibiting oscillations in the forward and rearward directions are brought in contact with the front and rear guide faces of the posts under the elastic force of the resiliently biasing means. Therefore, any irregularity present on the front and rear guide faces is effectively absorbed so that operation of the apparatus is constantly maintained in a joggling-free condition. Furthermore, since only the rollers for inhibiting oscillations in the forward and rearward directions are biased to contact the guide faces, the biasing force is not transmitted to the rollers for inhibiting lateral oscillations. Thus, possible frictional wear of the rollers for inhibiting lateral oscillations can be minimized; the operation environment can be prevented from becoming unfavorably affected by dust generation; and the clearance between each roller and each respective guide face can be prevented from becoming enlarged.

DESCRIPTION OF THE PREFERRED EMBODIMENT

One embodiment of the invention will now be described with reference to the accompanying drawings.

Figure 4:
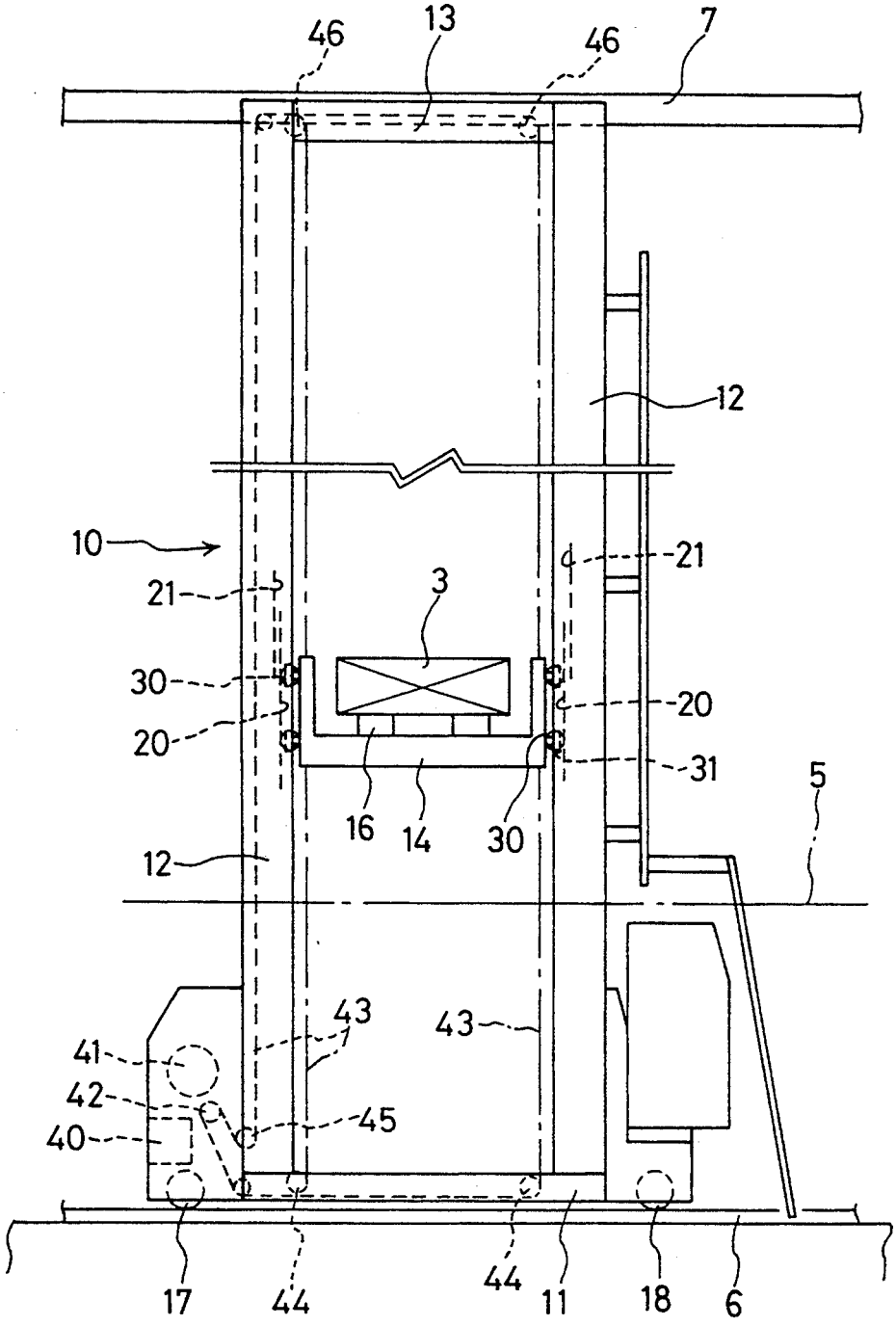
FIG. 4 is a side view showing the handling apparatus in its general appearance.
Figure 5:
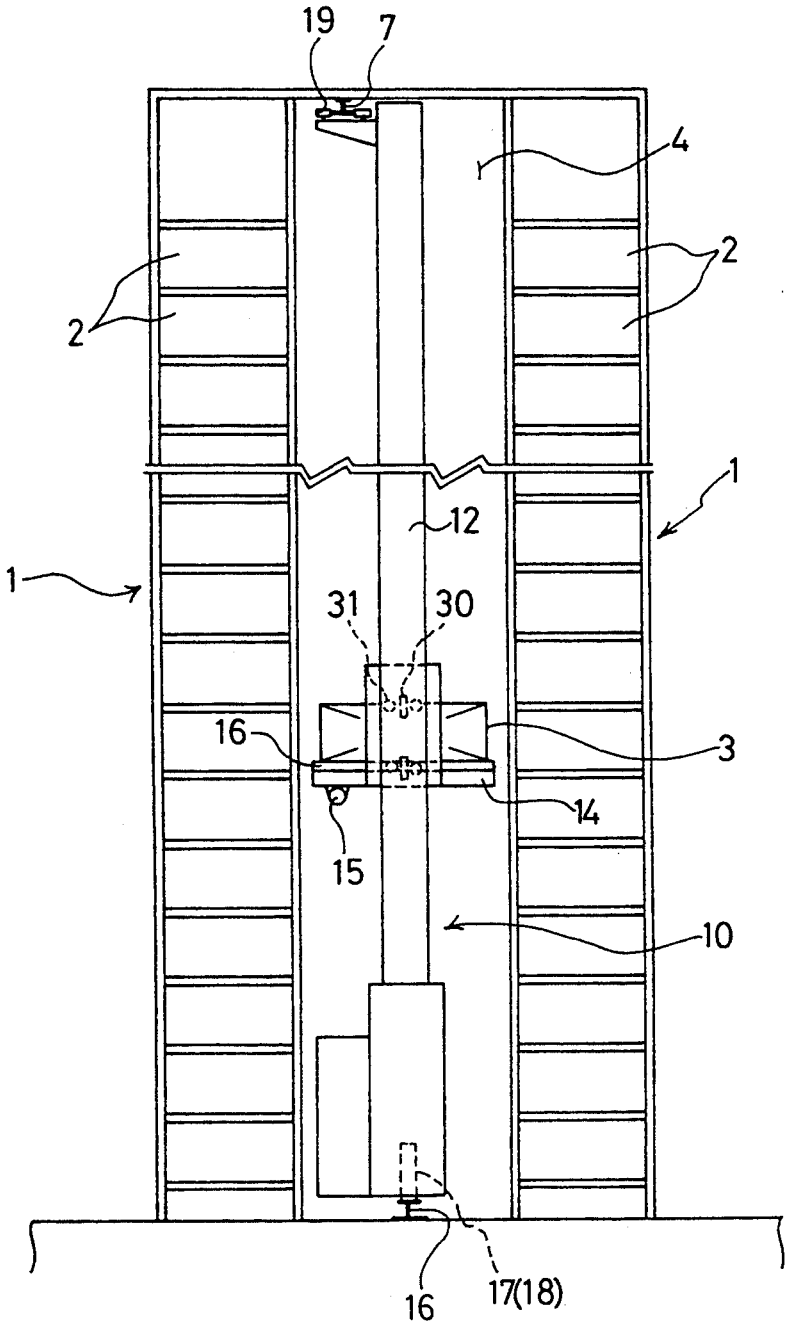
FIG. 5 is a front view showing the automatic warehousing arrangement in its general configuration.

As can be seen from FIGS. 4 and 5, a pair of framework-like racks 1 have vertically and horizontally defined storage sections 2 in pluralities. Each storage section 2 can support a load 3 directly therein through a support arm or support a load 3 placed on a pallet. The pair of racks 1 are arranged in parallel across a passage 4 within which is disposed a handling apparatus 10 movable on a predetermined track 5.

The handling apparatus 10 includes a body comprising a lower travel carriage 11, a pair of longitudinally spaced posts 12 extending vertically from the travel carriage 11, and an upper frame 13 interconnecting the top ends of the posts 12. Disposed between the two posts 12 is an elevator 14 on which is mounted a handling device 16 in the form of fork or the like which is retractably stretchable relative to storage sections 2 through the operation of a stretch/retract drive unit 15. The travel carriage 11 carries a drive wheel 17 and a driven wheel 18 which are movable in rolling contact with a floor rail 6, the drive wheel and driven wheel being longitudinally spaced from each other. The upper frame 13 carries guide rollers 19 guided along a ceiling rail 7.

Figure 1:
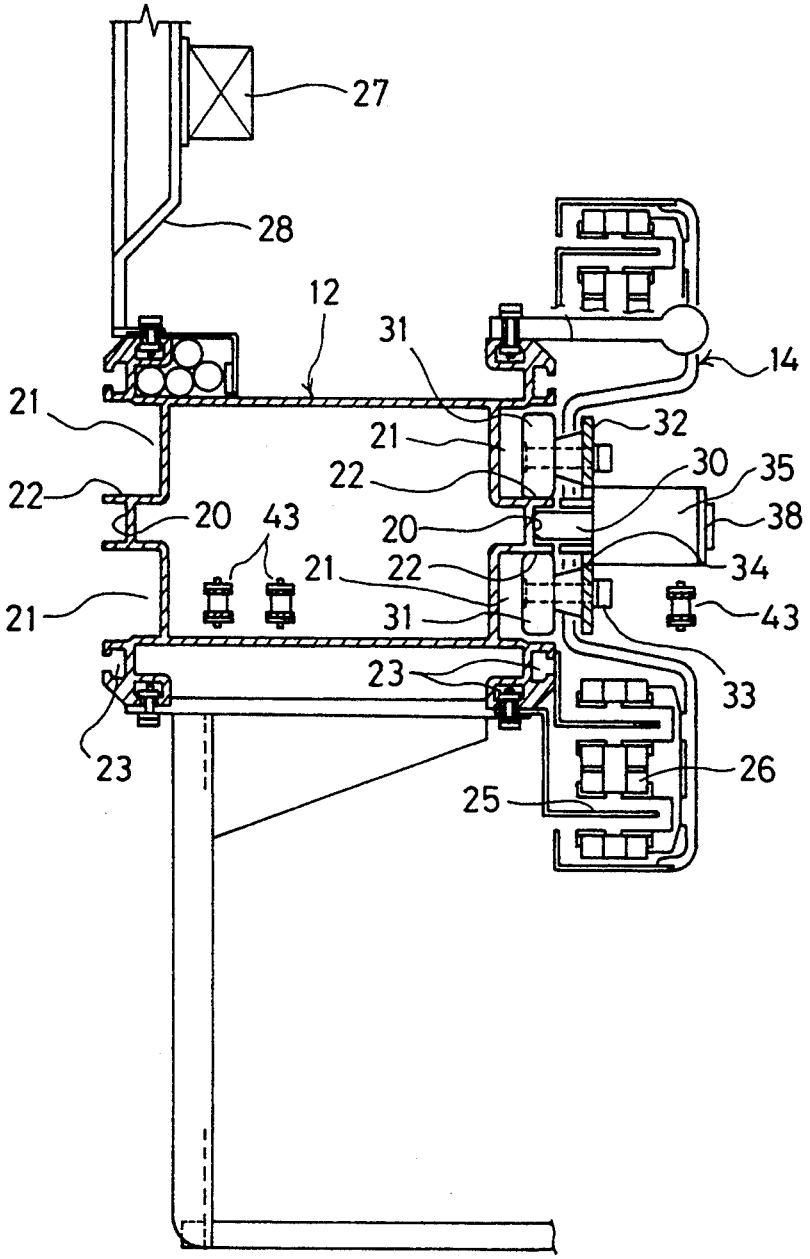
FIG. 1 is a cross-sectional plan view showing portions of a post including a vertical guide portion in a handling apparatus for automatic warehousing arrangement which represents one embodiment of the invention.
Figure 2:
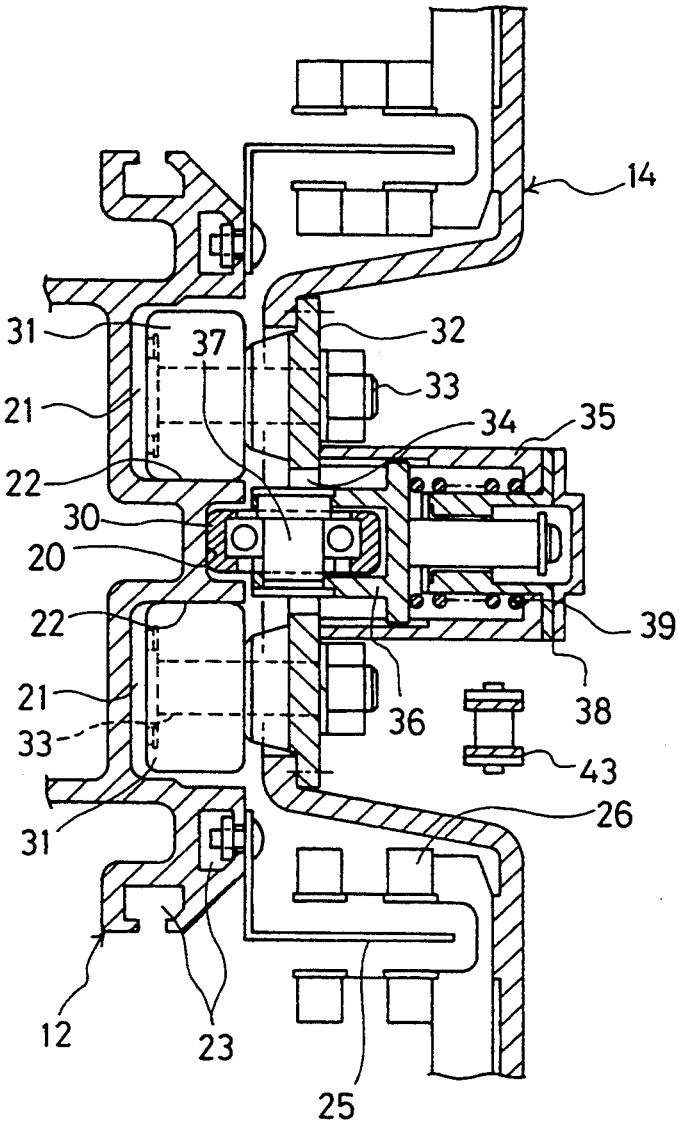
FIG. 2 is a plan view in cross section showing on an enlarged scale a portion of that part of the apparatus which is seen in FIG. 1.
Figure 3:
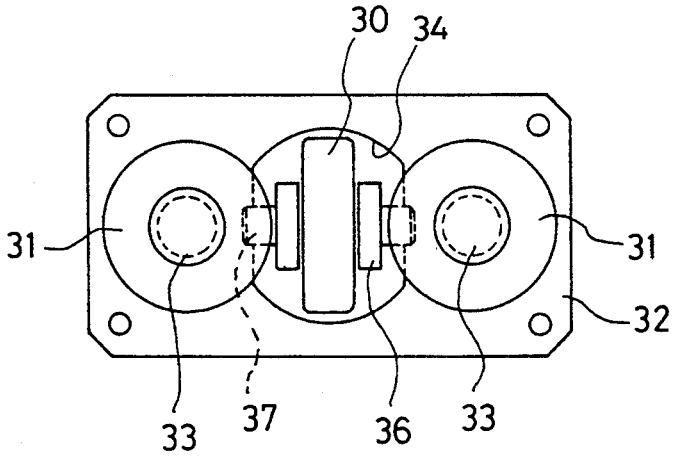
FIG. 3 is a fragmentary front view showing on an enlarged scale the portion shown in FIG. 2.

As FIGS. 1 to 3 show, each post 12 is comprised of a hollow rectangular aluminum draw molding. The pair of posts 12 are arranged in longitudinally symmetrical relation and may be of a unitary draw molding.

The posts 12 have opposed guide faces 20, front and rear, formed transversely centrally of their opposed surfaces, front and rear, which guide faces 20 are each defined by a shallow and narrow open groove. At both sides of that portion of each post 12 which is formed with such a guide face 20 there are formed deep and broad recesses 21 in integral relation with the post 12. The pair of recesses 21 each have two sides of which the one closer to the center of the post 12 defines a side guide face 22. At four corners of each post 12, there are formed dovetail grooves 23 for connection with other parts.

The elevator 14 is provided with rollers 30 for inhibiting oscillations in the forward and rearward directions which are guided by the front and rear guide faces 20, and a pair of rollers 31 for inhibiting lateral oscillations which are guided by side guide faces 22. More specifically, brackets 32 are fixed at both ends of the elevator 14 and transversely centrally thereof, and a pair of roller shafts 33, right and left, project from the brackets 32 in the longitudinal directions of the elevator. Each roller 31 for inhibiting lateral oscillations is free-rotatably fitted on the roller shafts 33 and is formed of an elastic resin material, such as urethane. The pair of rollers 31 for inhibiting lateral oscillations are held in abutment against side guide faces 22 as they are elastically deformed. Thus, there is created a condition such that the post 12 is held between the pair of rollers 31 in abutment therewith.

The brackets 32 are each centrally formed with a through-hole 34 which communicates with a cylindrical member 35 attached to the inner side of the brackets 32. A roller bracket 36 is slidably disposed within the cylindrical member 35. Roller 30 for inhibiting oscillations in the forward and rearward directions is free-rotatably mounted to the roller bracket 36 via a transverse shaft 37. A compression coil spring 39 is provided between a cover member 38 disposed at an inner end of the cylindrical member 35 and the roller bracket 36 so that the roller 30 for inhibiting oscillations in the forward and rearward directions is allowed to resiliently abut the front or rear guide face 20.

Those of the dovetail grooves 23 of the post 12 which are located at two corners adjacent the vertical travel path of the elevator 14 are available for attachment thereto of a sensor plate 25 for controlling, for example, the vertical movement of the elevator 14. A photoelectric switch 26 for detecting the sensor plate 25 is attached to the elevator 14. Those of the dovetail grooves 23 which are located opposite to the vertical travel path are available for attachment thereto of, for example, a guide member 27 via a bracket 28 for a feeder line placed between the elevator 14 and the frame-configured handling apparatus 10.

That part of the travel carriage 11 which is located outward of any post 12 is equipped with a travel drive unit 40 and a vertical drive unit 41. The travel drive unit 40 includes a motor with a reduction gear, the output shaft of which is geared to the drive wheel 17. The vertical drive unit 41 includes a motor with a reduction gear, the output shaft of which is fitted with a driving sprocket 42.

Two vertical drive chains 43 are trained about the driving sprocket 42 and are guided upward, at one end side, respectively along opposed surfaces of the two posts 12 via lower guide sprockets 44 arranged on the travel carriage 11, the one end of each drive chain 43 being connected to a lower portion of the elevator 14. The other end of each drive chain 43 is guided upward through the hollow interior of the corresponding post 12 via a guide sprocket 45 disposed on the travel carriage 11 and is then guided downward along the corresponding one of the opposed surfaces of the two posts 12 via one of upper guide sprockets 46 arranged on the upper frame 13, the other end being then connected to a top portion of the elevator 14. Portions of the chains 43 which are arranged along opposed surfaces of the posts 12 are each positioned opposite to one of the pair of recesses 21 formed in each respective post 12.

In such automatic warehousing arrangement, the handling apparatus 10 can perform entry and discharge of load 3 relative to a target storage section 2 of the rack 1 through a combination of vertical movement of the elevator 14 and lateral stretch/retract movement of the handling device 16.

For the above purpose, upward and downward movement of the elevator 14 is performed by turning the drive sprocket 42 forward and reverse by the vertical drive unit 41 for upward and downward movement of the chains 23. The chains 43 while in movement will joggle back and forth, but by virtue of the relief space formed in each post 12 via recess 21 with respect to the direction of such joggle, the chains 43 can be prevented from striking against the posts 12. Other kind of cord element, such as wire rope, may be used instead of chain 43 in moving the elevator 14 upward and downward. In this case, similar joggles may occur, but the wire rope can be effectively prevented from colliding with the posts 12.

The pair of rollers 31 on the elevator 14 which inhibit lateral oscillations eliminate the possibility of lateral jolting during stretch/retract operation of the handling device 16 for transfer of load 3, because the side guide faces 22 are forcibly held intact between the rollers 31. This permits smooth and accurate stretch/retract operation of the handling device 16, so that operation, when performed at high speed, can be maintained in a low noize condition. Similarly, upward and downward movement of the elevator 14 can be performed jolting-free. Any irregularity present on the side guide faces 22 is absorbed by the resiliency of the lateral oscillation inhibiting rollers 31 and thus operation can be constantly maintained in a jolting-free condition.

At the front and rear guide portions, rollers 30 for inhibiting oscillations in the forward and rearward directions are held in abutment against the front and rear guide faces 20, whereby any surface irregularity present on the front and rear guide faces 20 is effectively absorbed so that operation is constantly maintained in a jolting-free condition. In this case, only rollers 30 for inhibiting oscillations in the forward and backward directions are allowed to move for abutment against the guide faces 20 and the force of such movement is not transmitted to the rollers 31 for inhibiting lateral oscillations.

In the foregoing embodiment, the posts 12 are symmetrically molded of aluminum with respect to their front and back and lateral aspects. However, it may be arranged that each post has a recess 21 at only one location opposite to the chains 43.

What is claimed is:

1. A handling apparatus for automatic warehousing arrangement comprising:

a travelling carriage body, a pair of front and rear posts vertically extending from the travelling carriage body and spaced from each other in the direction of movement of the carriage body, said front and rear posts each having opposed surfaces, front and rear guide faces formed on the opposed surfaces of the posts, an elevator guided at one and the other ends thereof by the front and rear guide faces for upward and downward movement along the guide faces, cord means for vertically driving the elevator arranged along at least one of the opposed surfaces of the pair of posts and connected to the elevator, and relief spaces defined on the opposed surfaces of the posts at a position opposite to the cord means so as to provide a spacing between the cord means and the respective posts, wherein recesses are formed integrally with each respective post, front side or rear side, in pair at both sides of the guide face of the post, and wherein each of the recesses has a pair of inner sides and one of the inner sides which is closer to the center of the post defines a side guide face for guiding the elevator, and wherein the relief spaces are each defined by one said recess which is formed open toward the cord means in each respective post.

2. A handling apparatus as set forth in claim 1, wherein side portions of the posts at corners thereof for forming the recesses are formed with dovetail grooves for connection with other members.

3. A handling apparatus as set forth in claim 1, and further including rollers for inhibiting oscillations in the forward and backward directions which are disposed on the elevator and guided by the front and rear guide faces, and rollers formed of an elastic resin material for inhibiting lateral oscillations which are disposed on the elevator and guided by the side guide faces.

4. A handling apparatus as defined in claim 1, and further including rollers for inhibiting oscillations in the forward and backward directions which are disposed on the elevator and guided by the front and rear guide faces, means for elastically urging the forward and backward oscillation inhibiting rollers for abutment against the front and rear guide faces, and rollers for inhibiting lateral oscillations which are disposed on the elevator and guided by the side guide faces.

* * * * *